US007460679B2

(12) United States Patent
Itoh et al.

(10) Patent No.: US 7,460,679 B2
(45) Date of Patent: Dec. 2, 2008

(54) FLAT PANEL SPEAKER SYSTEM WITH A COATED DIAPHRAGM

(75) Inventors: Satoshi Itoh, Mie (JP); Tetsuya Mouri, Mie (JP); Masahide Sumiyama, Mie (JP); Shoji Kamii, Mie (JP)

(73) Assignee: Panasonic Corporation, Osaka (JP)

( * ) Notice: Subject to any disclaimer, the term of this patent is extended or adjusted under 35 U.S.C. 154(b) by 617 days.

(21) Appl. No.: 10/534,272

(22) PCT Filed: Oct. 1, 2004

(86) PCT No.: PCT/JP2004/014889

§ 371 (c)(1),
(2), (4) Date: May 9, 2005

(87) PCT Pub. No.: WO2005/034572

PCT Pub. Date: Apr. 14, 2005

(65) Prior Publication Data

US 2006/0042870 A1 Mar. 2, 2006

(30) Foreign Application Priority Data

Oct. 6, 2003 (JP) ..... 2003-346837

(51) Int. Cl.
*H04R 25/00* (2006.01)
*H04R 1/00* (2006.01)

(52) U.S. Cl. ..... 381/184; 381/182; 381/423

(58) Field of Classification Search ..... 381/150, 381/152, 182, 184, 345, 349, 350, 351, 396, 381/398, 423; 181/148, 164, 183
See application file for complete search history.

(56) References Cited

U.S. PATENT DOCUMENTS

| | | | | |
|---|---|---|---|---|
| 3,185,020 | A * | 5/1965 | Thelen | 359/586 |
| 6,554,098 | B1 | 4/2003 | Komura | |
| 6,740,202 | B2 * | 5/2004 | Ishigaki et al. | 381/426 |
| 7,020,302 | B2 * | 3/2006 | Konishi et al. | 381/424 |
| 2003/0003879 | A1 | 1/2003 | Saiki et al. | |
| 2003/0007653 | A1 | 1/2003 | Azima et al. | |

FOREIGN PATENT DOCUMENTS

| | | | |
|---|---|---|---|
| JP | 62133067 | * | 12/1985 |
| JP | H1-159487 | * | 11/1989 |
| JP | 08-001896 | | 1/1996 |
| JP | 2000-358290 | | 12/2000 |
| JP | 2003-179988 | | 6/2003 |
| WO | WO 99/37121 A1 | | 7/1999 |

* cited by examiner

*Primary Examiner*—Brian Ensey
(74) *Attorney, Agent, or Firm*—McDermott Will & Emery LLP

(57) ABSTRACT

A speaker system having a structure in which the room surrounding the first diaphragm and the room adjacent to the second diaphragm are acoustically coupled. The second diaphragm has coating on a surface. Applying the coating to the second diaphragm enhances the reliability and performance of the speaker system. Besides, the diversely definable geometry of the diaphragm allows an electronic device employing the speaker system or the speaker module to have flexibility in design.

14 Claims, 4 Drawing Sheets

PRIOR ART

FLAT PANEL SPEAKER SYSTEM WITH A COATED DIAPHRAGM

TECHNICAL FIELD

The present invention relates to a speaker system, a speaker module used for video and audio devices and communications devices, and also relates to electronic devices employing the speaker system or the speaker module, such as a mobile phone and a video game machine.

BACKGROUND ART

A conventional speaker system will be described first, with reference to FIG. 5. FIG. 5 is a sectional view of a conventional speaker system. In the structure shown in FIG. 5, magnet 1 is placed between upper plate 2 and yoke 3 to form inner magnetism-type magnetic circuit 4. Yoke 3 of magnetic circuit 4 is connected with frame 6. On the periphery of frame 6, first diaphragm 7 is attached and further on which, voice coil 8 is fixed to fit in magnetic gap 5 of magnetic circuit 4.

Besides, panel 9 is fixed on the periphery of frame 6, and further on panel 9, substantially flat second diaphragm 10 is attached. With the structure above, first diaphragm 7 and second diaphragm 10 are acoustically coupled through enclosed room 11. Sound through-hole 12 in enclosed room 11 acoustically couples first diaphragm 7 to second diaphragm 10, determining the positional relation between the two diaphragms. A speaker system having such a through-hole is introduced, for example, in Japanese Patent Unexamined Publication No. 2003-179988.

The conventional speaker system, however, has inconveniencies—second diaphragm 10 has often suffered thermal deformation due to high temperatures, or scratches on the surface by rubbing against other objects because of being exposed.

Furthermore, second diaphragm 10 can warp by its own weight, or can be pulled to panel 9 by static electricity, so that panel 9 has often made a tight contact with second diaphragm 10 and has hampered vibrations of diaphragm 10. This has often increased sound distortion, which can be a threat against improvements in performance and reliability of the speaker system.

DISCLOSURE OF THE INVENTION

The speaker system of the present invention contains a frame connected to a magnetic circuit; a first diaphragm attached to the outer periphery of the frame; a voice coil attached to the first diaphragm so as to partly fit into a magnetic gap of the magnetic circuit; a panel attached to the frame; a room enclosed by the second diaphragm-attached panel; and second diaphragm acoustically coupled to the room surrounded by the panel. In the structure above, the second diaphragm has a coating layer. With the structure, the two diaphragms can be effectively shaped and positioned so as to make use of the enclosed room between the two diaphragms, which increases flexibility in design. Besides, applying coating on the second diaphragm enhances the performance and reliability of a speaker system, a speaker module, and electronic devices employing the speaker system or the speaker module.

DETAILED DESCRIPTION OF CARRYING OUT OF THE INVENTION

Figure 1A:
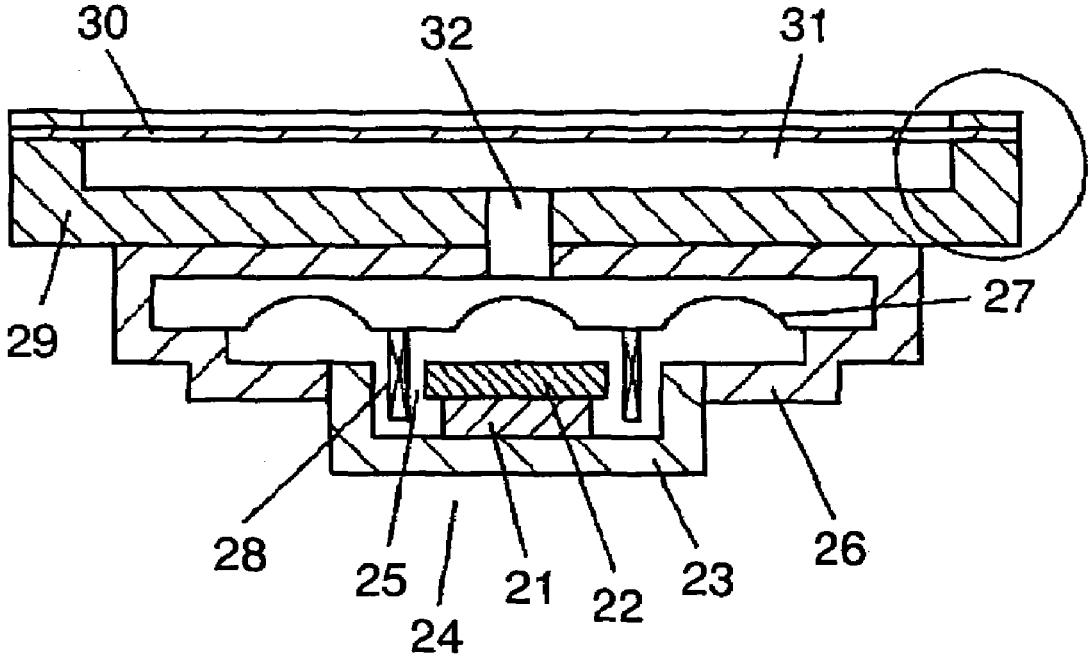
FIG. 1A is a sectional view of a speaker system of an exemplary embodiment of the present invention.

The speaker system of the present invention contains a frame connected to a magnetic circuit; a first diaphragm attached to the outer periphery of the frame; a voice coil attached to the first diaphragm so as to partly fit into a magnetic gap of the magnetic circuit; a panel attached to the frame; a room enclosed by the panel to which the second diaphragm is attached; and second diaphragm acoustically coupled to the room surrounded by the panel. In the structure above, the second diaphragm has a coating layer. With the structure, the two diaphragms can be effectively shaped and positioned so as to make use of the enclosed room between the two diaphragms, which increases flexibility in design. Besides, applying coating to the second diaphragm enhances its performance and reliability.

The speaker system of the present invention employs a scratch-resistant material for the coating material applied to the second diaphragm. As for the coating material, cross-linkable acrylic resin is desirable; in particular, ultraviolet curable acrylic resin is much preferable. Scratch resistance of the second diaphragm can be enhanced by coating a material formed of cross-linkable acrylic resin over the surface of the second diaphragm. Furthermore, employing the ultraviolet curable acrylic resin shortens the time for the forming process of the coating material, thereby increasing the productivity. Methacrylate resin is included in the aforementioned cross-linkable acrylic resin.

As another aspect of the present invention, the speaker system employs a heat-resistant material for the coating material of the second diaphragm. As for the material, silicon-base resin is preferable, which contributes to an increased heat resistance of the second diaphragm. Applying the coating material of silicon-base resin to both sides of the second diaphragm is much preferable—the double coating allows the coefficients of thermal expansion and contraction of the second diaphragm and the coating material to determine at a same rate on both sides, thereby enhancing the stability in shape with no warp even in a slight change of temperatures.

As yet another aspect of the present invention, the speaker system employs an antireflection material for the coating material of the second diaphragm. As for the material, a transparent resin having fine particles dispersed therein is desirable. Employing such a material can suppress the reflection of light on the second diaphragm, thereby increasing visibility of signs or markings disposed beneath the second diaphragm.

As still another aspect of the speaker system of the present invention, the second diaphragm has a single-layered or multilayered coating combining any one of a scratch-resistant material, a heat-resistant material, and an antireflection material on one side, or both sides. With the structure, an advantage of each material is selectively obtained as necessary, and more than one effects can be expected in the combined coating and multi-layered coating.

As another aspect of the speaker system of the present invention, the first diaphragm is smaller than the second diaphragm. By employing the structure for speaker modules and electronic devices, such modules and devices can be further compact, giving enhanced flexibility in design.

As still another aspect of the speaker system of the present invention, a transparent film is used for the second diaphragm. By virtue of the transparency, signs and markings disposed beneath the second diaphragm can be easily read. By employing the structure for speaker modules and electronic devices, such modules and devices can be further compact, giving enhanced flexibility in design.

As yet another aspect of the speaker system of the present invention, the second diaphragm has microscopic irregularity on the panel-side surface. With the structure, the second diaphragm and the flat panel disposed in the narrow gap can be fairly free from attracting each other by static electricity, and they have no surface-to-surface contact with each other. Therefore, reliability of frequency response can be improved.

As still another aspect of the speaker system of the present invention, the panel has microscopic irregularity on the surface on the side of the second diaphragm. In this case, too, the second diaphragm and the flat pane facing each other via the narrow gap can be fairly free from attracting each other by static electricity, and they have no surface-to-surface contact with each other. Therefore, reliability of frequency response can be improved.

The speaker module of the present invention has a structure in which the display section is located under the second diaphragm of the speaker system. With the structure, the display section and the speaker system can be incorporated in a compact module.

The electronic device of the present invention contains the speaker module of the present invention and an operation panel. The structure reduces the physical size of an electronic device.

As described above, the present invention relates to a speaker system using the second diaphragm having scratch-resistant, heat-resistant, or anti-reflection coating. Besides, the speaker system employs the second diaphragm and the panel—either one of which has microscopic irregularity on the surface—to form acoustically coupled-type speaker system.

Furthermore, the structure, in spite of having a relatively large second diaphragm 30, encourages further downsizing of a speaker module, providing the module with flexibility in design.

Hereinafter, the exemplary embodiments of the present invention will be described with reference to the accompanying drawings.

First Exemplary Embodiment

Figure 1B:
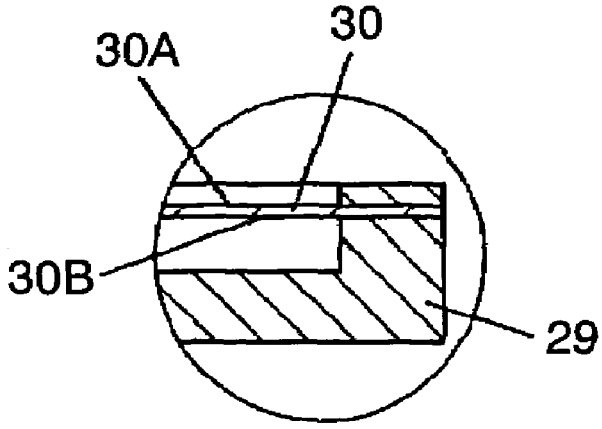
FIG. 1B is an enlarged sectional view of the essential part encircled in FIG. 1A.

FIG. 1A is a sectional view of a speaker system of an embodiment of the present invention. FIG. 1B is an enlarged view of the essential part encircled in FIG. 1A. In the structure shown in FIGS. 1A and 1B, magnet 21 is placed between upper plate 22 and yoke 23 to form inner magnetism-type magnetic circuit 24. Yoke 23 of magnetic circuit 24 is connected with frame 26. The outer periphery of first diaphragm 27 is attached on the periphery of frame 26. Voice coil 28 is so disposed that one end is fixed to first diaphragm 27 and the other end is fit in magnetic gap 25 of magnetic circuit 24.

Besides, panel 29 is fixed on the periphery of frame 26, and further on panel 29, substantially flat second diaphragm 30 is attached. Enclosed room 31 acoustically couples, via sound through-hole 32, first diaphragm 27 with second diaphragm 30. Second diaphragm 30 is coated with material that enhances the reliability and performance of diaphragm 30.

By employing a scratch-resistant material for coating material, the surface of second diaphragm 30—usually exposed to outside—is protected by a hard coat. As for the coating material, cross-linkable acrylic resin is desirable. In particular, ultraviolet curable acrylic resin is much preferable. The coating can protect second diaphragm 30 from scratches due to rubbing against other objects, thereby improving scratch resistance of diaphragm 30. Furthermore, the use of aforementioned ultraviolet curable acrylic resin can shorten the time for drying the coating material, thereby increasing the productivity.

Material with high heat resistance, such as silicon-base resin, can be the coating material. The use of heat-resistant material can protect second diaphragm 30 under high temperatures, preventing diaphragm 30 from heat deformation, i.e., enhancing heat resistance of diaphragm 30. Furthermore, applying the heat-resistant coating material to both sides of second diaphragm 30 is much preferable—the double coating allows the coefficients of thermal expansion and contraction of the second diaphragm and the coating material to determine at a same rate on both sides, thereby enhancing the stability in shape with no warp even in a slight change of temperatures.

An antireflection material can be employed for the coating material. The use of antireflection coating material decreases the reflection of light on second diaphragm 30, thereby increasing visibility of signs or markings disposed beneath diaphragm 30. As for the material, a transparent resin having fine particles dispersed therein is desirable. The similar effect can be obtained by embossing the surface after coating.

The coating can be formed such that combinations of different coating layers or multi-layered coating of different coating materials on either side of front surface 30A or back surface 30B, or on both sides. That is, one of surface 30A or surface 30B, or both surfaces may be covered with the coating layers formed of the materials with high scratch resistance, heat resistance, and antireflection. With the structure, an advantage of each material is selectively obtained according to requested performance.

With the use of the aforementioned coating material, a coating layer can be differently formed on front surface 30A and back surface 30B of second diaphragm 30. With the coating, an advantage of each coating material is selectively obtained according to requested performance.

Furthermore, multi-layered coating combined with any one of coating materials above can be applied to second diaphragm 30. With the structure, an advantage of each material is selectively obtained according to requested performance, and a plurality of effects or synergy effect can be expected in the multi-layered coating.

The structure of the embodiment, as described above, can enhance the reliability and performance of second diaphragm 30.

Second Exemplary Embodiment

Figure 2:
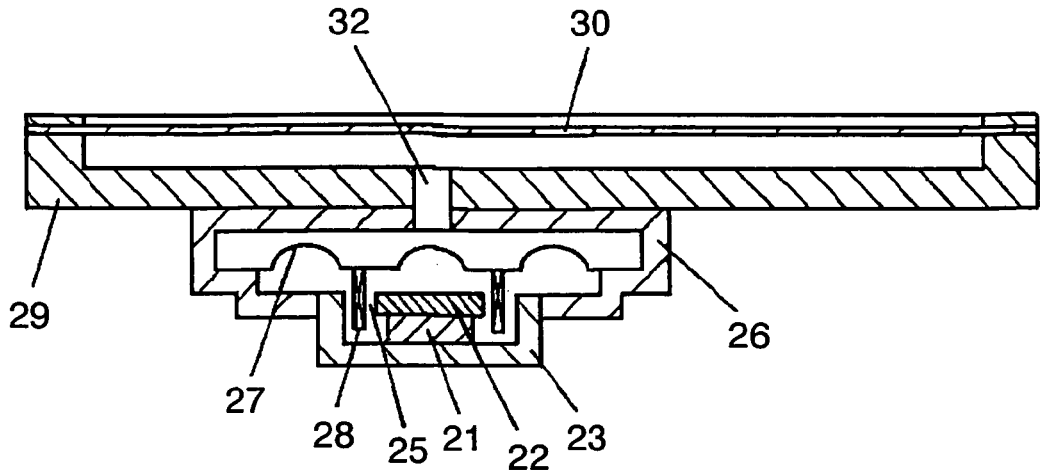
FIG. 2 is a sectional view of another speaker system of an exemplary embodiment of the present invention.

FIG. 2 illustrates the structure of a speaker system of the second embodiment of the present invention. The speaker system of the embodiment employs first diaphragm 27 having an outer diameter smaller than that of second diaphragm 30. To be more specific, second diaphragm 30 has an outer diameter large enough to include the whole structure of first diaphragm 27. In spite of having a relatively large second diaphragm 30, the structure above encourages further downsizing of a speaker module, providing the module with flexibility in design.

Third Exemplary Embodiment

In the speaker system of the third embodiment, a transparent film is used for second diaphragm 30. By virtue of the transparency, items disposed beneath the second diaphragm can be easily read. The exploitable space under the transparent film allows the parts-layout to expand in the vertical direction, as well as in the horizontal direction. Therefore, in spite of having a relatively large second diaphragm 30, the structure above encourages further downsizing of a speaker module, as well as giving flexibility in design.

Fourth Exemplary Embodiment

According to the speaker system of the fourth embodiment, microscopic irregularity are disposed either i) on the surface of second diaphragm 30 on the side of panel 29 or ii) on the surface of panel 29 on the side of second diaphragm 30. With the structure, the second diaphragm and the flat panel disposed in the narrow gap can be fairly free from attracting each other by static electricity, and they have no surface-to-surface contacting with each other. Therefore, the structure free from sound distortion can improve the reliability of frequency characteristics.

Fifth Exemplary Embodiment

Figure 3:
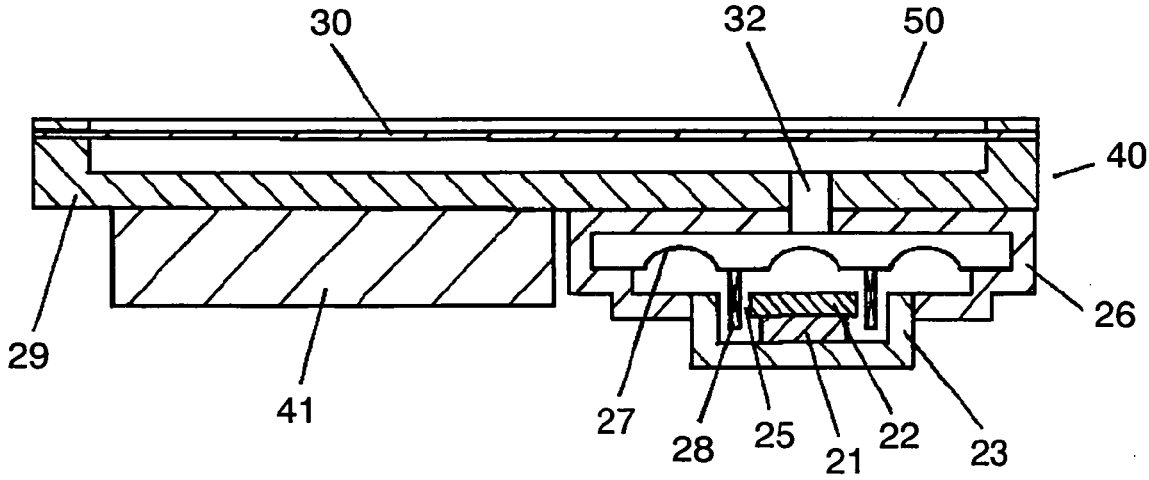
FIG. 3 is a sectional view of a speaker module of an exemplary embodiment of the present invention.

Hereinafter will be described a speaker module of the fifth embodiment of the present invention. FIG. 3 shows a speaker module having at least display section 41 and speaker system 40. Speaker system 40 employs second diaphragm 30 described in the first through fourth embodiments. Speaker module 50 has a structure in which speaker system 40 is laid over display section 41 so as to cover display section 41. Second diaphragm 30 of the embodiment is formed of a transparent film, and a part of frame 29 at least facing second diaphragm 30 is made of a transparent material. With the structure, display section 41 disposed beneath the transparent film sheet can be seen through panel 29 from the direction of second diaphragm 30.

In an acoustically coupled speaker module having room for improvement in miniaturization and flexibility in design, the use of the structure above enhances the reliability and performance of exposed second diaphragm 30. Forming such a module can simplify the processes in assembly lines or in parts distribution, thereby contributing to cost-reduced production.

Sixth Exemplary Embodiment

Figure 4A:
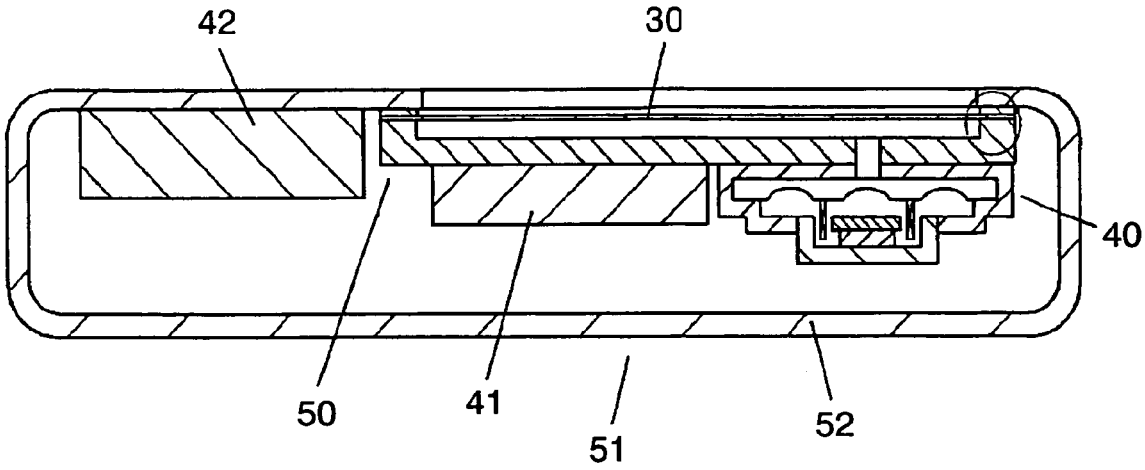
FIG. 4A is a sectional view of another speaker module of an exemplary embodiment of the present invention.
Figure 4B:
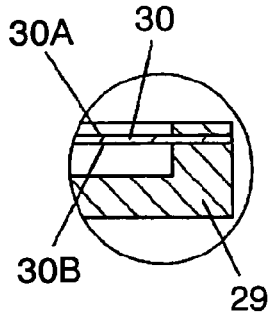
FIG. 4B is an enlarged view of the essential part encircled in FIG. 4A.
Figure 5:
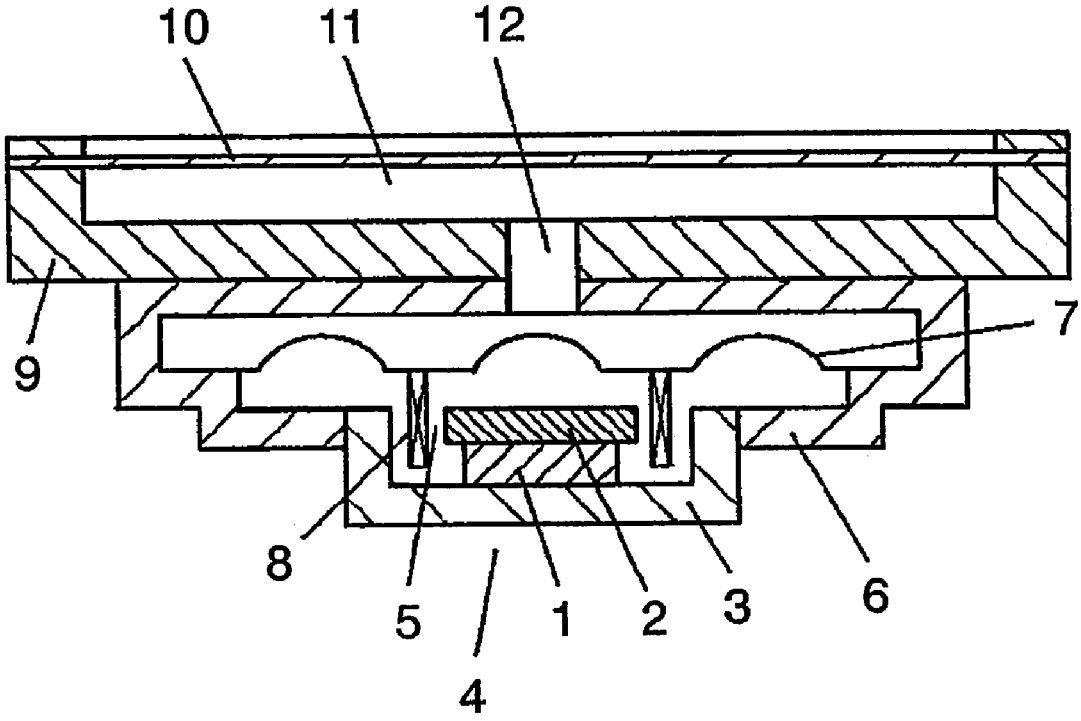
FIG. 5 is a sectional view of a conventional acoustically coupled-type speaker system.

FIG. 4A is a sectional view of a mobile phone that employs a speaker module of an embodiment of the present invention. FIG. 4B shows the essential part of encircled in FIG. 4A.

The electronic device of FIG. 4A is mobile phone 51 formed of i) speaker module 50 at least containing display section 41 and speaker system 40 and ii) operating section 42.

Mobile phone 51 employs speaker module 50 described in the fifth embodiment. The essential part of the device is so formed that speaker module 50 is attached to outer case 52 and operating section 42 is located next to speaker module 50.

Front surface 30A of second diaphragm 30 of speaker module 50, as shown in FIG. 4B, is provided with coating having high heat-resistance, scratch-resistance, and antireflection. On back surface 30B of diaphragm 30, microscopic irregularity and heat-resistant coating are applied.

Display section 41 is located in the space under second diaphragm 30 made of transparent film and the transparent panel, and operating section 42 is disposed next to display section 41. The structure allows mobile phone 51 to have a compact body and to enhance flexibility in design, improving the reliability and performance of exposed second diaphragm 30.

Operating section 42 can be integrated into the panel, for example, as a touch panel, and both of display section 41 and operating section 42 can be disposed in the space under the transparent film. In this case, too, applying coating over transparent film-made second diaphragm 30 can improve the reliability and performance of the diaphragm.

The structure of the present invention can thus promote miniaturization, flexibility in design, and reliability and performance of mobile phone 51.

INDUSTRIAL APPLICABILITY

The speaker system and the speaker module of the present invention employ a transparent film and a transparent panel for the structure. By virtue of the transparency, the display section disposed under the panel can be easily seen, i.e., the display section can be located adjacent to the sound producing section. The structure can be widely employed for video and audio equipment, communications equipment, video game machines, and the like.

The invention claimed is:

1. A speaker system comprising:

a frame coupled to a magnetic circuit;

a first diaphragm fixed on a outer periphery of the frame;

a voice coil, one end of which is fixed to the first diaphragm and an other end of which is fit within a magnetic gap of the magnetic circuit;

a panel attached to the frame;

a room surrounded by the panel to which a second diaphragm is attached; and the second diaphragm acoustically coupled with the room surrounded by the panel, wherein the second diaphragm has a front coating material on a front surface and a back coating material on a back surface, and the front coating material is different from the back coating material.

2. The speaker system according to claim 1, wherein the coating layer is formed of scratch-resistant material.

3. The speaker system according to claim 1, wherein the coating layer is formed of heat-resistant material.

4. The speaker system according to claim 1, wherein the coating layer is formed of antireflection material.

5. The speaker system according to claim 1, wherein at least one surface of the second diaphragm has single-layered, or multi-layered coating material formed of any one of scratch-resistant, heat-resistant, and antireflection materials.

6. The speaker system according to claim 1, wherein the first diaphragm is smaller than the second diaphragm.

7. The speaker system according to claim 1, wherein the second diaphragm is a transparent film.

8. The speaker system according to claim 1, wherein the panel is made of a transparent material.

9. The speaker system according to claim 1, wherein the second diaphragm is a transparent film, and the panel is made of a transparent material.

10. The speaker system according to claim 1, wherein the second diaphragm has microscopic irregularity on a surface confronting the panel.

11. The speaker system according to claim 1, wherein the panel has microscopic irregularity on a surface confronting the second diaphragm.

12. The speaker system according to claim 1, wherein the frame forms a first room surrounding the first diaphragm, the second diaphragm and the panel form a second room, and the first room and the second room are connected through a hole.

13. A speaker module comprising:

a speaker system described in claim 9; and a display section, wherein, the display section is attached under the speaker system and the display section can be seen through the second diaphragm or the panel.

14. An electronic device comprising:

a speaker module described in claim 13; and an operating section, wherein, a user can operate the operating section while watching the display section through the second diaphragm or the panel.

* * * * *